US006264524B1

(12) United States Patent
Crane et al.

(10) Patent No.: US 6,264,524 B1
(45) Date of Patent: Jul. 24, 2001

(54) TOY FIGURE WITH REMOVABLE SUCTION CUP

(75) Inventors: Judith A. Crane, Chicago; Michael R. Crane; Cyril Crane, both of Downers Grove, all of IL (US)

(73) Assignee: JAC Investments, Inc., Elk Grove Village, IL (US)

( * ) Notice: Subject to any disclaimer, the term of this patent is extended or adjusted under 35 U.S.C. 154(b) by 0 days.

(21) Appl. No.: 09/419,549

(22) Filed: Oct. 18, 1999

(51) Int. Cl.[7] ..... A63H 33/00
(52) U.S. Cl. ..... 446/177; 40/597
(58) Field of Search ..... 273/DIG. 25; 446/72, 446/177, 268; 40/597; 224/559

(56) References Cited

U.S. PATENT DOCUMENTS

| | | | | |
|---|---|---|---|---|
| 2,219,130 | * | 10/1940 | Hermann | 40/597 |
| 4,152,865 | | 5/1979 | Ikeda . | |
| 4,235,041 | * | 11/1980 | Sweet | 446/177 |
| 4,258,500 | * | 3/1981 | Anderson | 446/177 |
| 4,794,025 | * | 12/1988 | Yamanaka | 446/177 |
| 5,078,640 | | 1/1992 | Berman . | |
| 5,080,941 | * | 1/1992 | Kosowan | 40/597 |
| 5,288,257 | * | 2/1994 | Zacherl | 446/177 |
| 5,397,124 | * | 3/1995 | Nevel | 273/DIG. 25 |
| 5,430,965 | * | 7/1995 | Lai | 40/597 |
| 5,502,909 | * | 4/1996 | Rabkin | 40/597 |

* cited by examiner

*Primary Examiner*—Sam Rimell
(74) *Attorney, Agent, or Firm*—Knechtel, Demeur & Samlan

(57) ABSTRACT

A toy figure is provided with multiple orifices which enable a suction cup to be releasably retained within the orifices. The suction cup is attached to the toy figure through an engagement member which is inserted into and received by the orifice. The orifices are positioned on the figure to allow the figure to assume different orientations with respect to the surface to which the suction cup is attached.

15 Claims, 1 Drawing Sheet

TOY FIGURE WITH REMOVABLE SUCTION CUP

I. FIELD OF THE INVENTION

The present invention relates to a toy figure and, more particularly, to a toy figure that has multiple orifices which enable a suction cup to be releasably retained within the orifices and, thereby, permit the toy figure to be situated on a variety of surfaces and arranged in a variety of positions.

II. DESCRIPTION OF THE PRIOR ART

Children are amused and entertained by toy figures, especially toy figures that capture the attention and fantasy of children through the depiction and animation of the toy figures in television shows and movies. The toy figures contain characteristics that encourage and stimulate the enjoyment and imagination of the children.

Several toy figures have been designed with useful characteristics to further the playful and practical uses of the toy figures for the children. For example, U.S. Pat. No. 3,969,837 to Kresse entitled "Display Figure" discloses a display figure that has an elongated backing strip that forms an open tube within the display figure to receive an elongated staff. The staff is used to support the display figure while being held by the child or positioned in a suitable location for further playfulness when not being held. Likewise, U.S. Pat. No. 5,078,640 to Berman entitled "Plaything Usable As A Crutch Pad" discloses a plaything that serves both as a stuffed figure or animal for playing and as a crutch pad when not being played with. A shortcoming of these figures is that although the figures are usable as play toys for the children, the figures prohibit use and enjoyment in conjunction with a variety of surfaces or positions when not in the childrens' hands which stifles the childrens' ability to simulate the superhuman characteristics of the toy figure. Another shortcoming is that the toy figures are limited in their use and, therefore, the children must rely solely upon their own imagination to play with the toy figure while remaining within the design limitations of the toy figures.

Several toy figures have been designed with gripping or holding characteristics to increase the use and enjoyment of the toy figure and to foster the childrens' imagination. For example, U.S. Pat. No. 4,152,865 to Ikeda entitled "Greeting Card With Holding Toy" discloses a holding toy in the form of an animal that has spring loaded limbs to secure the holding toy upon a greeting card. Likewise, U.S. Pat. No. 5,288,257 to Zacherl entitled "Toy Figure Door Stop Having Door Adhering/Suction Cups" discloses a toy figure that has a flexible body with several appendages affixed with suction cups to secure the toy figure to a door and, thereby, act as a door stop when not being played with. A shortcoming of these devices is that the toy figures are only usable in one position and, therefore, are not useful or playful in a variety of other positions. Another shortcoming is that these devices are not suitable for placement on a variety of surfaces and, therefore, the toy figure limits the encouragement and stimulation of imagination that the children receive from the toy figure. Another shortcoming is that these toy figures are not capable of exhibiting superhuman characteristics such as flying.

A toy figure that is suitable for placement on a variety of surfaces and that is capable of exhibiting superhuman characteristics is U.S. Pat. No. 4,235,041 to Sweet entitled "Figure Toy" which discloses a toy figure with suction cups that cover the entire body of the toy figure to permit the toy figure to adhere to various smooth surfaces. A shortcoming of this toy figure is that the suction cups are not removable from the body of the toy figure and, therefore, the children are prohibited from playing with the toy figure without the suction cups. Another shortcoming of this toy figure is that multiple suction cups are used to adhere the toy figure to a smooth surface and, therefore, the flexibility and movement of the toy figure while adhered to the smooth surface is limited. Another shortcoming is that when the toy figure is adhered to the smooth surface, the children are forced to play with the opposite side of the toy figure which is covered in suction cups and, thereby, reduces the enjoyment of the toy figure by the children. Still another shortcoming is that the suction cups are not flush to the body of the toy figure which permits the suction cups to be snagged or pulled from the toy figure. Still another shortcoming is that the toy figure is completely covered with suction cups and, therefore, is neither an aesthetically pleasing toy nor presents a friendly or receptive toy for the children.

Thus, there is a need and there has never been disclosed a toy figure that provides a releasably retainable suction cup sufficient to effectively attach a toy figure to a variety of surfaces and in a variety of positions, due to multiple orifices contained within the toy, and, therefore, stimulates the use and enjoyment of the toy figure by the children.

III. OBJECTS OF THE INVENTION

It is the primary object of the present invention to provide a toy figure that provides multiple orifices for releasably retaining a suction cup. A related object of the present invention is to enable the toy figure to be attached to a variety of different surfaces and arranged in a variety of different positions while attached to the various surfaces.

Another object of the present invention is to provide a toy figure that is capable of exhibiting superhuman characteristics. A related object of the present invention is to provide a toy figure that encourages and stimulates the imagination of the children.

Still another related object of the present invention is to provide a toy figure that fosters the playfulness of the children. A related object of the present invention is to provide a toy that is safe for children and easy to use.

Other objects of the present invention will become more apparent to persons having ordinary skill in the art to which the present invention pertains from the following description taken in conjunction with the accompanying drawings.

IV. SUMMARY OF THE INVENTION

The present invention is a toy figure that provides multiple orifices which enable a suction cup to be releasably retained within the orifices. The orifices comprise a channel and a retaining cavity. The suction cup comprises an engagement member with an extension member and a head. The extension member is used to insert the head through the channel and into the retaining cavity where the head is securely held in place by the retaining cavity until removed by the user.

V. BRIEF DESCRIPTION OF THE DRAWINGS

The Description of the Preferred Embodiment will be better understood with reference to the following figures.

VI. DETAILED DESCRIPTION OF THE PREFERRED EMBODIMENT

Figure 1:
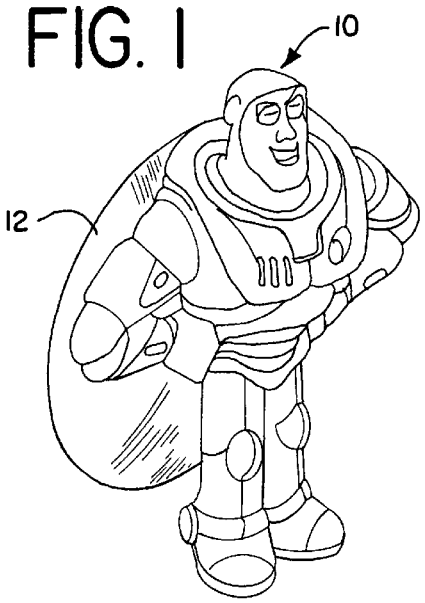
FIG. 1 is a front perspective view of the toy figure as assembled with the suction cup attached to back of the toy figure.

Turning first to FIG. 1, there is illustrated a toy figure 10 that is depicted as assembled with an attached suction sup 12. The toy figure 10 is preferably made of a soft, plastic or rubber material that is safe for children. The toy figure 10 may be any figure including but not limited to any type of character, superhero, robot, alien, animal, or any other type of figure that children would enjoy to play with.

The suction cup 12 is preferably made of a soft, flexible, plastic material that is also safe for children. The flexibility of the suction cup 12 serves to permit releasable attachment of the suction cup 12 to the toy figure 10. The details of the attachment of the suction cup 12 to the toy figure 10 are discussed in FIGS. 4 and 5 below.

Figure 2:
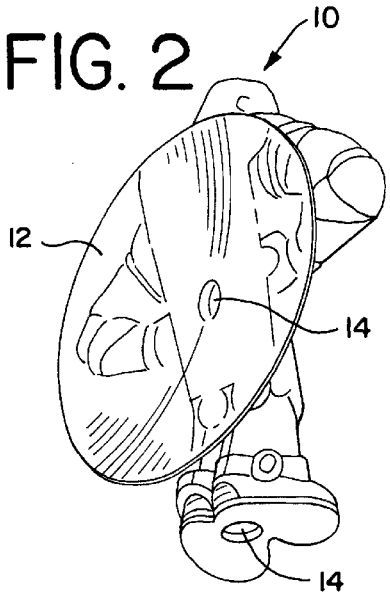
FIG. 2 is a rear perspective view of the toy figure that illustrates the multiple orifices contained within the toy figure and illustrates the suction cup as attached to one of the orifices.

Turning to FIG. 2, the toy figure 10 is illustrated with multiple orifices 14 and with the suction cup 12 attached to one of the orifices 14. In the preferred embodiment, the suction cup 12 may be attached to any one of the orifices 14. Preferably, the orifices 14 are located on the back of the toy figure 10 and under the feet of the toy figure 10. Alternatively, the orifices 14 may be located on the top or side. In the preferred embodiment, the orifices 14 are positioned in the center of the back and feet of the toy figure 10. The central locations of the orifices 14 permit the toy figure 10 to be adequately supported by the suction cup 12 when the suction cup 12 is attached to the orifices 14. For example, when the suction cup 12 is attached to the back of the toy figure 10 and then to a surface, the toy figure 10 is positioned parallel to the surface facing outwardly. The appearance to the children will be that the toy figure 10 is flying a long the surface or, with imagination, to the moon. Alternatively, when the suction cup 12 is attached to the bottom of the toy figure 10 and then to a surface, the toy figure 10 is positioned perpendicularly to the surface . The appearance to the children will be that the toy figure 10 is flying away from the surface or, with imagination, over a city. Alternatively, by placing multiple figures in an upright, standing position, various action scenes can be created.

Figure 3:
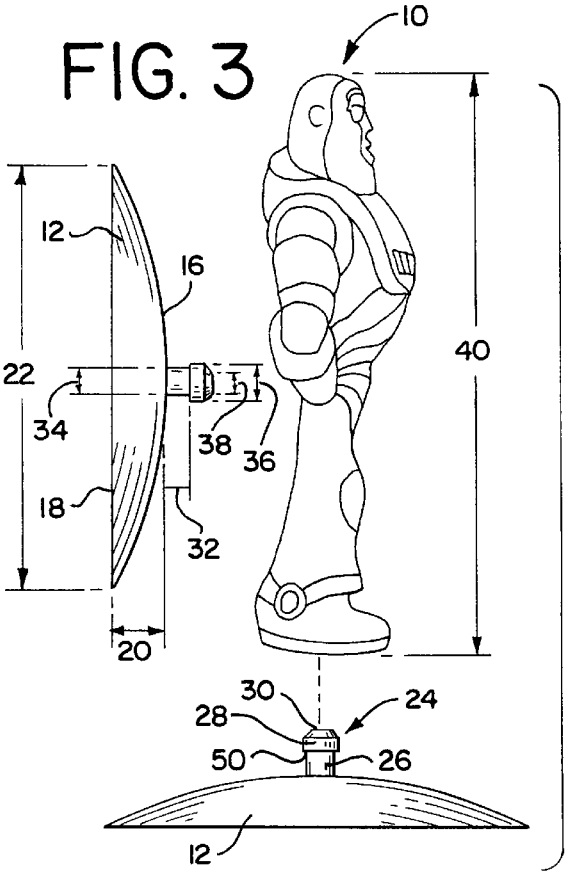
FIG. 3 is an exploded side elevational view of the toy figure and detached suction cup showing two possible positions for insertion of the suction cup into any one of the multiple orifices in the toy figure.

In FIG. 3, two different orientations are shown for inserting the suction cup 12 into the orifices 14. The suction cup 12 is illustrated in alignment with either of two orifices 14 of the toy figure 10. The suction cup 14 has a convex top 16, a bottom 18 and a diameter 22. The convex top 16 and the bottom 18 are separated by a variable width 20. In the preferred embodiment, the bottom 18 of the suction cup 12 is attachable to a smooth, non-porous surface such as glass. It is contemplated that children will attach the suction cup 12 to the windows of a vehicle or home. Alternatively, the bottom 18 of the suction cup 12 is attachable to walls or any other type of material that a suction cup would adhere to and be used by a child to play with the toy figure 10.

Extending outwardly from the apex of the convex top 16 of the suction cup 12 is an engagement member 24. The engagement member 24 consists of an extension member 26, a head 28, and a tip 30. Preferably, the extension member 26 is cylindrical in shape, has an extension length 32 and a extension member diameter 34. The head 28 has a head diameter 36 which is slightly larger than the extension member diameter 34. The tip 30 has a tapering configuration terminating in a tip diameter 38 which is slightly less than the extension member diameter 34.

In the preferred embodiment, the toy figure 10 has a toy height 40 which is slightly larger than the diameter 22 of the suction cup 12. Alternatively, the diameter 22 of the suction cup 12 may be larger or smaller than the toy height 40 as long as the diameter 22 of the suction cup 12 is sufficient to allow the suction cup to adhere to a surface and effectively remain attached to that surface while engaged with the toy figure 10.

Figure 4:
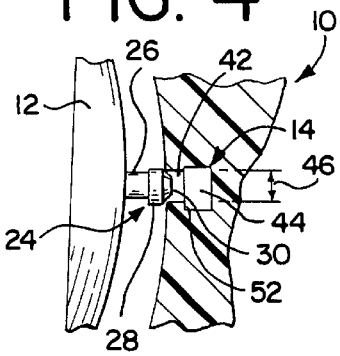
FIG. 4 is an enlarged side sectional view with portions removed depicting an orifice within the toy figure and the suction cup prior to insertion into the orifice.

In FIG. 4, the suction cup 12 is shown prior to insertion into the orifice 14 of the toy figure 10. The engagement member 24 is inserted into and releasably retained within the orifice 14 to secure the suction cup 12 to the toy figure 10.

The orifice 14 has a channel 42 and a retaining cavity 44. In the preferred embodiment, the channel 42 has a channel diameter 46 which is slightly larger than the tip diameter 38. This permits easier alignment and insertion of the head 28 into the channel 42. Alternatively, the tip diameter 38 could be as large as the head diameter 36, but this would make it difficult to insert the head 28 into the channel 42. In the preferred embodiment, the channel diameter 46 of the channel 42 is slightly less than the head diameter 36. This permits the head 28 to be secured within the retaining cavity 44. As the head 28 is made of a soft, flexible plastic material, the head 28 is enabled to compress slightly to the channel diameter 46 and, thereby, allow insertion of the head 28 through the channel 42 and into the retaining cavity 44.

In the preferred embodiment, the channel 42 has a channel diameter 46 which is slightly larger than the extension member diameter 34. This permits easy insertion of the extension member 26 through the channel 42 to situate the head 28 within the retaining cavity 44.

Figure 5:
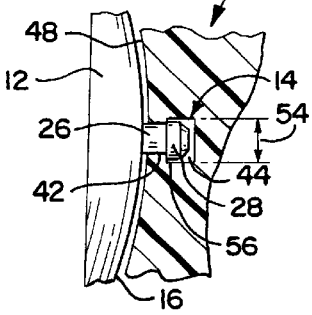
FIG. 5 is an enlarged side sectional view with portions removed of the suction cup securely held in position within the toy figure by the orifice.

In FIG. 5, the suction cup 12 is illustrated as attached to the toy figure 10 with the engagement member 24 releasably retained within the orifice 14. In the preferred embodiment, the toy figure 10 has a concave engagement surface 48 which approximates the convex top 16 of the suction cup 12. Upon insertion of the engagement member 24 into the orifice 14, the engagement surface 48 of the toy figure 10 is flush with the convex top 16 of the suction cup 12. In the preferred embodiment, the extension member 26 facilitates the flush nature of the toy figure 10 and the suction cup 12 as the extension member length is approximately equal to the length of the channel 42.

The head 28 is secured within the toy figure 10 by the retaining cavity 44. The head 28 has a securing ledge 50 (FIG. 3) and the retaining cavity 44 has a retaining ledge 52 (FIG. 4). The head 28 is inserted through the channel 42 and into the retaining cavity 44. The retaining cavity 44 has a cavity diameter 54 that permits the head 28 to expand from the compressed channel diameter 46 to the head diameter 36 which is less than the cavity diameter 54. As the head 28 reaches the retaining cavity 44, the securing ledge 50 engages a retaining ledge 52 at contact point 56 to secure the head 28 within the retaining cavity 44. To release the head 28, the user merely pulls the suction clip 12 away from the figure 10. As the head 28 is made of flexible material, it compresses and is released from the retaining cavity 44.

Thus, there has been provided a toy figure that is designed with multiple orifices for releasably retaining a suction cup that enables the toy figure to be adhered to various surfaces and to be situated in various positions due to the location of the suction cup. While the invention has been described in conjunction with a specific embodiment, it is evident that many alternatives, modifications and variations will be apparent to those skilled in the art in light of the foregoing description. Accordingly, it in intended to embrace all such alternatives, modifications and variations as fall within the spirit and scope of the appended claims.

What is claimed is:

1. A toy figure for attachment to a smooth, non-porous surface, comprising:

a figure having a front side, a back side, a top side, and a bottom side, a first orifice and a second orifice, the first orifice located on the back side of the figure and the second orifice located on the bottom side of the figure, each orifice having a channel and a retaining cavity; and a suction cup having a first surface and a second surface, the first surface having a convex shape with an engagement member extending outwardly from the first surface of the suction cup, the engagement member having an extension member, a head having a securing ledge thereon, and a tip, the tip and the head being inserted through the channel of either the first orifice or the second orifice into the retaining cavity;

a retaining ledge in the retaining cavity, the securing ledge on the head engaging the retaining ledge when the head is inserted into the retaining cavity to secure the suction cup to the figure.

2. The toy figure of claim 1 wherein the head, channel, and retaining cavity are all cylindrical.

3. The toy figure of claim 1 wherein the suction cup is made of a soft, flexible, plastic material.

4. The toy figure of claim 1 wherein the back side of the figure is concave in shape.

5. The toy figure of claim 4 wherein the concave shape of the back side of the figure is approximately the same curvature as the convex shape of the first surface of the suction cup.

6. The toy figure of claim 1 wherein the bottom side of the figure is concave in shape.

7. The toy figure of claim 6 wherein the concave shape of the bottom side of the figure is approximately the same curvature as the convex shape of the first surface of the suction cup.

8. The toy figure of claim 2 wherein the head has a diameter which is slightly greater than the diameter of the channel.

9. The toy figure of claim 8 wherein the diameter of the head is slightly less than the diameter of the retaining cavity.

10. The toy figure of claim 1 wherein the extension member has a length which is approximately equal to the length of the channel.

11. The toy figure of claim 1 wherein the engagement member is located at the apex of the first surface of the suction cup.

12. The toy figure of claim 1 wherein the first orifice is located in the center of the back side of the figure.

13. The toy figure of claim 1 wherein the second orifice is located in the center of the bottom side of the figure.

14. A toy figure for attachment to a smooth surface, consisting of:

a figure having a front side, a back side, a top side, and a bottom side, and at least one orifice disposed on one of the sides; and having a straight releasable retainer means having a portion with an enlarged diameter;

a suction cup having a first surface and a second surface, the first surface having an engagement member extending outwardly from the first surface of the suction cup, the releasable retainer means retaining the engagement member within the orifice, the releasable retainer means comprises an enclosed cavity within the orifice to receive in releasable locking engagement the engagement member.

15. The toy figure of claim 14 wherein the engagement member comprises an elongated shaft and an enlarged head having a diameter greater than the diameter of the elongated shaft.

* * * * *